US008789485B2

(12) United States Patent
Juenger et al.

(10) Patent No.: US 8,789,485 B2
(45) Date of Patent: Jul. 29, 2014

(54) DEVICE FOR SECURING A PORTION OF A LINE

(76) Inventors: Arthur W. Juenger, Camdenton, MO (US); Mark A. Pearcy, Kansas City, MO (US)

( * ) Notice: Subject to any disclaimer, the term of this patent is extended or adjusted under 35 U.S.C. 154(b) by 0 days.

(21) Appl. No.: 13/404,144

(22) Filed: Feb. 24, 2012

(65) Prior Publication Data

US 2013/0220200 A1 Aug. 29, 2013

(51) Int. Cl.
*B63B 21/04* (2006.01)

(52) U.S. Cl.
USPC ..... 114/218; 114/199; 292/307 R; 24/134 R; 24/136 R; 24/481

(58) Field of Classification Search
USPC ..... 114/218, 199; 24/134 R
See application file for complete search history.

(56) References Cited

U.S. PATENT DOCUMENTS

| | | | | |
|---|---|---|---|---|
| 895,590 | A | 8/1908 | Sprague | |
| 1,189,679 | A | 7/1916 | Furey | |
| 1,272,392 | A | 7/1918 | Craven et al. | |
| 2,080,700 | A | 5/1937 | Dale | |
| 2,471,503 | A | 5/1949 | Ward et al. | |
| 3,437,982 | A | 4/1969 | O'Keefe et al. | |
| 3,863,299 | A | 2/1975 | Hocq | 24/71 J |
| 4,424,611 | A | 1/1984 | Mori | 24/192 |
| 4,425,862 | A | 1/1984 | Hirsch et al. | 114/199 |
| 4,541,149 | A | 9/1985 | Jensen | 24/134 R |
| 4,639,978 | A | 2/1987 | Boden | 24/134 R |
| 4,660,493 | A * | 4/1987 | Lowry, III | 114/199 |
| 4,878,270 | A | 11/1989 | Westerkamp | 24/132 R |
| 5,050,786 | A | 9/1991 | DeMott | 224/253 |
| 5,070,805 | A * | 12/1991 | Plante | 114/218 |
| 5,092,641 | A * | 3/1992 | Penick, Jr. | 292/307 R |
| 5,249,544 | A * | 10/1993 | Lacan | 114/204 |
| 5,327,845 | A | 7/1994 | Cook | 114/218 |
| 5,327,847 | A | 7/1994 | Cook | 114/218 |
| 5,408,729 | A * | 4/1995 | Schwartz et al. | 24/134 R |
| 5,931,112 | A * | 8/1999 | Lacan | 114/218 |
| 6,108,877 | A * | 8/2000 | Anscher et al. | 24/481 |
| 6,295,700 | B1 * | 10/2001 | Plzak | 24/134 R |
| 6,546,600 | B1 * | 4/2003 | Lyons | 24/136 R |
| D556,033 | S | 11/2007 | Ennest et al. | D8/383 |
| D635,452 | S | 4/2011 | Jones | D8/383 |
| 8,001,660 | B2 * | 8/2011 | Cai et al. | 24/136 R |

* cited by examiner

*Primary Examiner* — Lars A Olson
*Assistant Examiner* — Jovon Hayes
(74) *Attorney, Agent, or Firm* — Harness, Dickey & Pierce, P.L.C.

(57) ABSTRACT

A device for securing a length of rope includes a housing with at least one pair of apertures therein defining a passage through the housing for receiving a line of rope. The device includes a pin extending at least partially through the interior of the housing, and a torsion spring disposed within the housing. The device further includes at least one cam member with a grooved edge portion, pivotally mounted on the pin and biased by the torsion spring so as to pivot the cam member's grooved edge portion in a direction towards an interior wall of the housing for engaging a line of rope received within the passage between the cam member's grooved edge portion and the interior wall. The at least one cam member has a lever depending from the cam member, which enables pivotal movement of the cam.

20 Claims, 6 Drawing Sheets

DEVICE FOR SECURING A PORTION OF A LINE

FIELD

The present disclosure generally relates to devices for securing a portion of a line, for example, for securing a line to moor a vessel.

BACKGROUND

This section provides background information related to the present disclosure which is not necessarily prior art.

Devices for securing a portion of line, such as a rope, have many useful applications. For example, they can be used to engage a line when mooring a boat, eliminating the need to manually tie the line. Hand-tied lines can come loose, and once tied it can be difficult to adjust the length of the line without untying and retying the line.

SUMMARY

This section provides a general summary of the disclosure, and is not a comprehensive disclosure of its full scope or all of its features.

The present disclosure describes various embodiments of devices for securing a portion of a line in accordance with the principles of the present invention.

In one embodiment, a device for securing a portion of a line includes a housing with at least one pair of apertures therein defining a passage through the housing for receiving a portion of a line, such as a rope. At least one cam member is rotatably mounted in the housing, to rotate between first a position in which the cam member impinges on the passage through the housing to engage a portion of a line extending through the passage, and a second position in which the cam does not substantially impinge the passage in the housing and would not engage a portion of line extending therethrough. The at least one cam is resiliently biased to its first position, so that the cam be rotated to allow a portion of a line to be inserted or removed from the passage, but when the cam is released it rotates back to its first position impinging upon the passageway and engaging the portion of a line extending therethrough.

In some embodiments, the surface of the cam can have a groove therein to accommodate the portion of a line in the passage, particularly when the cam is in its second position. The surface of the cam can also have a structure, such as the edge of the groove, or teeth, or other structure for engaging the portion of the line in the passage when the cam is in its first position. The cam can be configured to allow the portion of the line to slip with respect to the cam in one direction (the direction of the movement of the surface of the cam from its first to second position), and to resist slipping of the line in the opposite direction (the direction of the movement of the surface of the cam from its second to its first position). This allows a line engaged by the device to be tightened without the need to manipulate the cam.

In some embodiments, the housing has two (or more) pairs of apertures defining two (or more) passages, each with its own cam. These embodiments can be used to engage portions of two (or more) different lines, or two (or more) different portions of the same line. The cams can be arranged so that the each pivot between their first and second directions in the same direction, or so that some of them pivot between their first and second directions in opposite directions. In the former case, the direction of slip of the line will be the same for each passage, in the latter case the direction of slip will vary from passage to passage. By constructing the device appropriately, or selecting the appropriate device, the user can determine whether, and in which direction, a line can slip relative to the device.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. According to various aspects of the present disclosure, various embodiments are provided of devices for securing a length of rope. In one exemplary embodiment, a device for securing a length of rope includes a housing with at least one pair of apertures therein defining a passage through the housing for receiving a line of rope, where the housing has an interior wall underlying the at least one aperture defining the passage. The device includes a pin extending at least partially through the interior of the housing, and a torsion spring disposed within the housing. The device further includes at least one cam member with a grooved edge portion, being pivotally mounted on the pin, and biased by the torsion spring, so as to pivot the cam member's grooved edge portion in a direction towards the interior wall for engaging a line of rope received within the passage between the cam member's grooved edge portion and the interior wall. The at least one cam member has a lever depending from the cam member, which enables pivotal movement of the cam member's grooved edge portion away from the interior wall for releasing a rope received within the passage between the cam member's grooved edge portion and the interior wall.

In some embodiments, the at least one pair of apertures comprises a first pair of apertures defining a first passage through the housing for receiving a first portion of a rope, and a second pair of apertures defining a second passage through the housing for receiving a second portion of the rope. Furthermore, the at least one cam member comprises a first cam member with a grooved edge portion, being pivotally mounted on the pin and biased by the torsion spring so as to pivot the first cam member and grooved edge portion towards the interior wall for engaging a length of rope received within the first passage, and a second cam member with a grooved edge portion, being pivotally mounted on the pin and biased by the torsion spring so as to pivot the second cam member and grooved edge portion in a direction towards the interior wall for engaging an end portion of the rope received within the second passage. The first and second pairs of apertures are arranged in the housing such that an end portion of a rope may be inserted through the first and second pair of apertures to form a loop to be secured around a mooring post or bollard.

Figure 1:
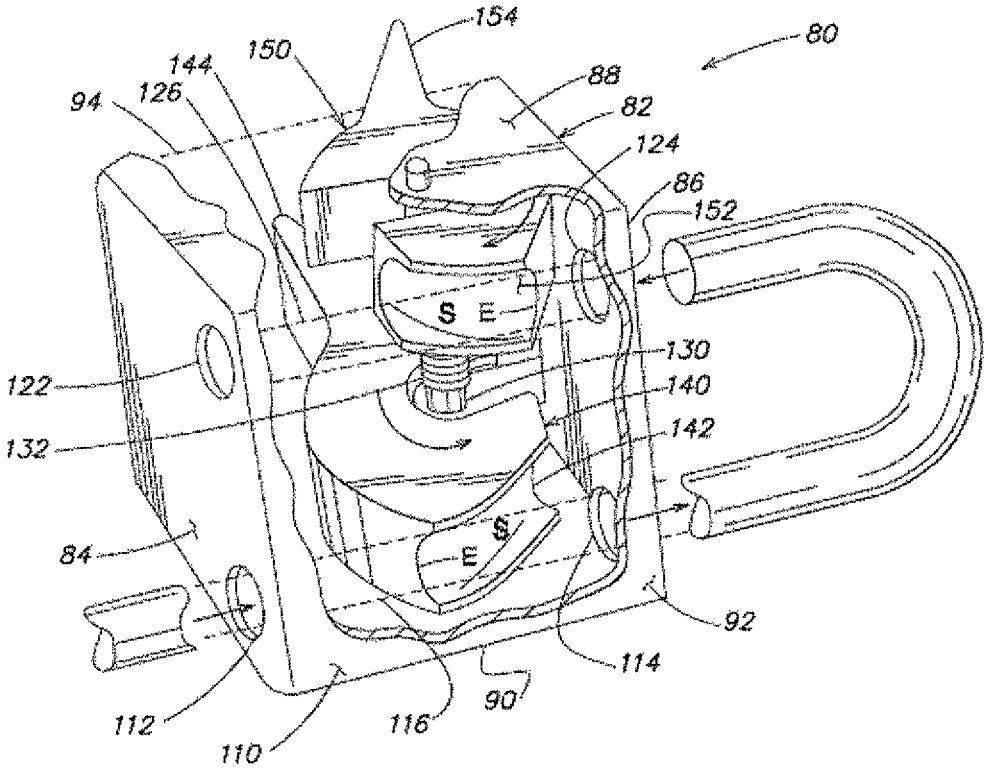
FIG. 1 is a cut-away of a bottom perspective view of one exemplary embodiment of a device for securing an end portion of a length of rope for mooring a vessel, according to one aspect of the present disclosure.

Referring to FIG. 1, a first embodiment of a device for securing a portion of a line, such as a rope (e.g., for mooring a vessel) is indicated generally as 80. The device 80 includes a housing 82, which as shown in FIG. 1, has a generally rectangular prismatic shape with opposed, parallel front and back walls 84 and 86, opposed, parallel left and right-side walls 88 and 90 extending between the front and back walls, a bottom 92 and an open top 94. Portions of the bottom 92 and the side wall 88 are broken away in FIG. 1 to show details of construction. The housing 82 has a first pair of apertures 112, 114 in the front and back walls 84 and 86, respectively, defining a first passage 116 through the housing 82 for receiving a portion of a line. In this preferred embodiment, the device also has a second pair of apertures 122, 124 in the front and back walls 84 and 86 defining a second passage 126 through the housing 82 for receiving a portion of a line therethrough. The interior side 110 of the bottom 92 underlying the first and second pairs of apertures (112, 114, 122, 124) defining the first and second passages 116, 126. The device 80 further includes a pin 130 extending at least partially through the interior of the housing 108, and at least one torsion spring 132 disposed on the pin within the housing 108.

The device 80 further includes a first cam member 140 pivotally mounted on the pin 130 to rotate between a first position in which the first cam member 140 impinges on the first passage 116, and a second position in which the cam member 140 does not impinge the first passage 116. The first cam member 140 can have a grooved edge portion 142 that engages a portion of a line extending through the first passage 116 when the first cam member is in its first position. The first cam member 140 can have a lever 144 depending therefrom, which is configured to enable pivotal movement of the first cam member between its first and second positions, to allow the user to move the first cam member to the second position to allow a portion of a line to be inserted or removed from the first passage 116.

The first cam member 140 can be configured to allow the portion of the line in the first passage 116 to slip with respect to the first cam member in one direction (the direction of the movement of the surface of the first cam member as it rotates from its first to second position), and to resist slipping of the line in the first passage 116 in the opposite direction (the direction of the movement of the surface of the first cam member as it rotates from its second to its first position).

The device 80 preferably also includes a second cam 150 pivotally mounted on the pin 130 to rotate between a first position in which the second cam member 150 impinges on the second passage 126, and a second position in which the second cam member 150 does not impinge the second passage 126. The second cam member 150 can have a grooved edge portion 152 that engages a portion of the line extending through the second passage 126 when the second cam member is in its first position. The second cam member 150 can have a lever 154 depending therefrom, which is configured to enable pivotal movement of the second cam member between its first and second positions, to allow the user to move the second cam member to the second position to allow a portion of a line to be inserted or removed from the second passage 126.

The second cam member 150 can be configured to allow the portion of the line in the second passage 126 to slip with respect to the first cam member in one direction (the direction of the movement of the surface of the second cam member as it rotates from its first to second position), and to resist slipping of the line in the second passage 126 in the opposite direction (the direction of the movement of the surface of the second cam member as it rotates from its second to its first position).

The torsion spring 132 biases the first and second cam members 140, 150 to urge the first and second cam members 140, 150 to rotate from their second positions to their first positions. In this first embodiment, the first and second cam members 140, 150 are arranged so that they rotate in opposite directions. This means that a single torsion spring 132 can bias the first and second cam members 140, 150 to their first positions. It further means that the portions of the lines engaged by each of the cam members 140, 150, can slip in opposite directions.

Figure 2:
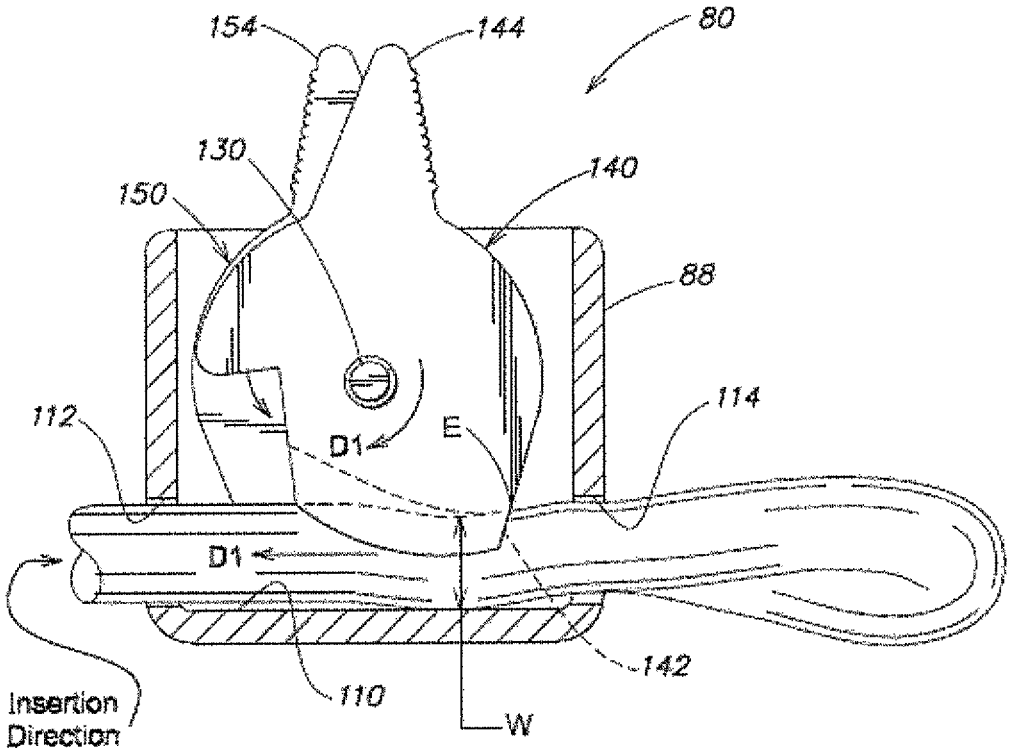
FIG. 2 is a cross-sectional view of the device shown in FIG. 1, according to an exemplary embodiment.

Referring to FIG. 2, the first cam member 140 is biased by torsion spring 132 (FIG. 1) so as to pivot the first cam member 140 and its grooved edge portion 142 in a first direction D1 to its first position engaging the portion of the line in the first passage 116. The first cam 140 engages the portion of the line in the first passage 116, resisting movement of the line in direction D1. However, the cam 140 can be configured to allow the portion of the line in first passage 116 to slip in the opposite direction (the "INSERTION DIRECTION" in FIG. 2). This allows the line to be pulled or tensioned without operating the first cam member 140. A line can be easily inserted into the first aperture 112, through the first passage 116, and out the second aperture 114, but movement of the line in direction D1 (opposite the "INSERTION DIRECTION") urges the sharp edge E of the grooved edge portion 142 to rotate into the line in the first passage 116, engaging the line more tightly.

Similarly, the second cam member 150 is biased by torsion spring 132 toward so as to pivot the second cam member 150 and its grooved edge portion 152 in a first direction to its first position engaging the portion of the line in the second passage 126. The second cam engages the portion of the line in the second passage 126, resisting movement of the line in a first direction. However, the second cam member can be configured to allow the portion of the line in second passage 126 to slip in the opposite direction. This allows the line to be pulled or tensioned without operating the second cam member 150. A line can be easily inserted into the second aperture 124, through the second passage 126, and out the aperture 122, but the movement of the line in the opposite direction (opposite the "INSERTION DIRECTION") urges the sharp edge E of the grooved edge portion 152 to rotate into the line in the second passage 126, engaging the line more tightly.

To insert a line into the device, the user can either force the line through the inlet side of the passage (aperture 112 for first passage 116, and aperture 124 for second passage 126), or operate the first or second cam member in the appropriate direction to move the cam member from its first position to its second position so that the cam member does not impinge on its respective passage. When the line has been inserted, the user simply releases the cam member, which under the resilient force of the spring 132 rotates to its first position engaging the portion of the line in its respective passage. The user can slide the line in one direction, but not in the other direction. When the user wishes to release the line, the user simply operates the first or second cam member 140, 150 from its first position to its second position, releasing the engagement of the cam member with the portion of the line in its respective passage 116 or 126, allowing the line to be removed.

Figure 3:
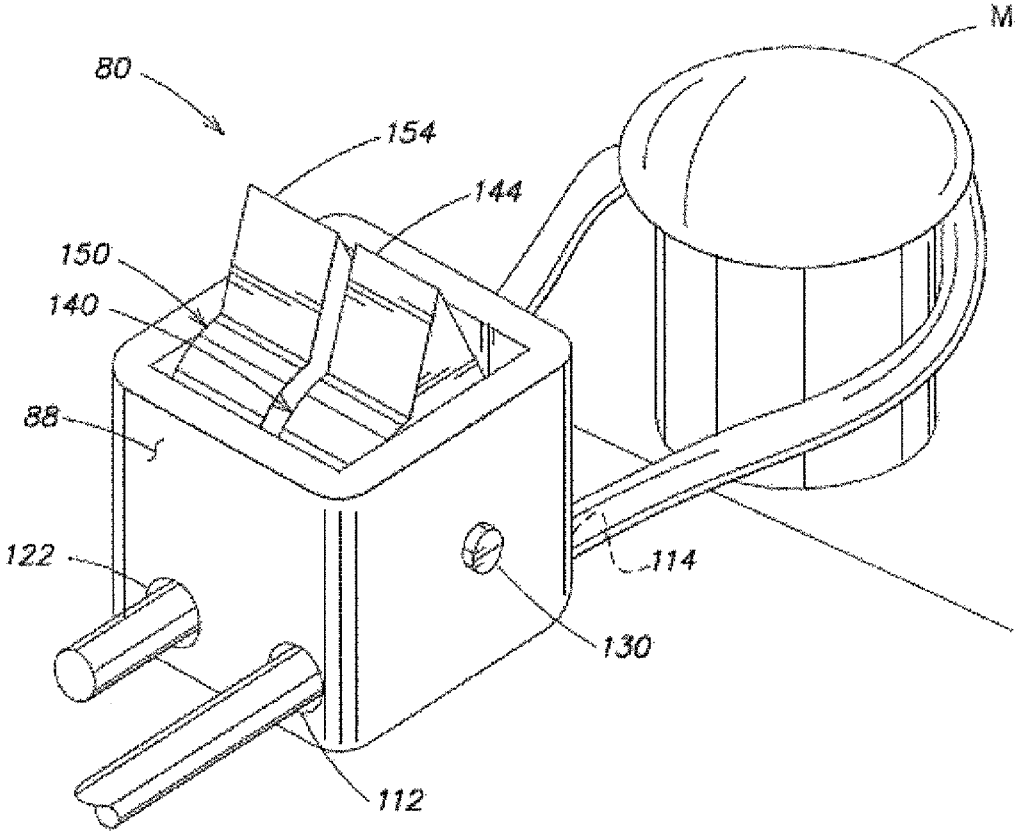
FIG. 3 is a top perspective view of the device in FIG. 1, shown securing an end portion of a length of rope for mooring a vessel.

Referring to FIG. 3, the device 80 of the first embodiment is shown engaging a line to thereby form a loop for attachment to a mooring post M. Because the first and second cam members 140, 150 are configured to restrain the rope against movement in a direction opposite to the insertion direction, a rope can easily be inserted through the apertures to form a loop that is restricted from being withdrawn from the device 80 unless the levers 144, 154 are pivoted to release the rope. Accordingly, the device 80 functions to easily establish a loop in a rope for use in mooring a vessel without having to tie a knot, and can withstand substantial loads without releasing the loop. In the first embodiment of a device 100, the device 100 was found to provide a restraining force of at least 500 pounds to a length of rope received within the first and second pairs of apertures.

Figure 4:
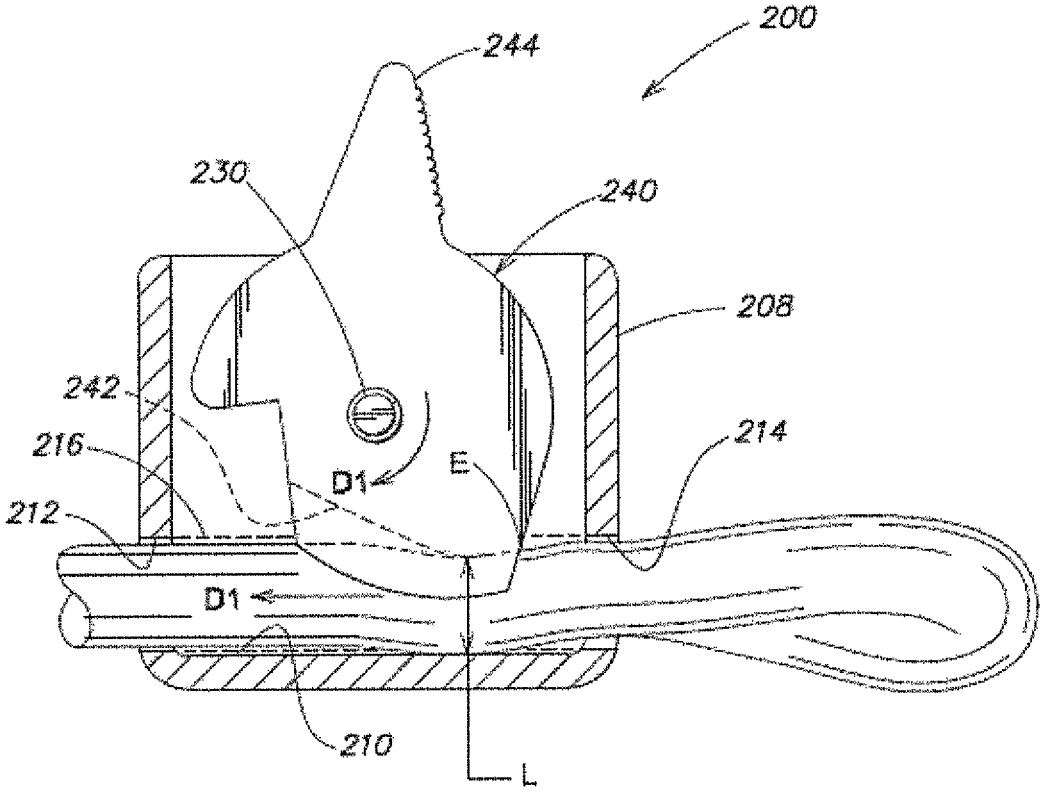
FIG. 4 is a cross-sectional view of a second embodiment of a device for securing an end portion of a length of rope, according to another aspect of the present disclosure.

Referring to FIG. 4, a second embodiment of a device for securing a portion of a length of rope is shown generally at 200. The device 200 includes a housing 208 with at least one pair of apertures 212, 214 therein defining a first passage 216 through the housing 208 for receiving a line of rope. The housing 208 has an interior wall 210 underlying the at least one aperture (212, 214) defining the first passage 216. The device 200 further includes a pin 230 extending at least partially through the interior of the housing 208, and a torsion spring (see FIG. 1) disposed in the housing 208. The device 200 further includes at least one cam member 240 with a grooved edge portion 242, being pivotally mounted on the pin 230 and biased by the torsion spring so as to pivot the cam member 240 and grooved edge portion 242 in a direction towards the interior wall 210 for engaging a line of rope received within the first passage 216 between the cam member's grooved edge portion 242 and the interior wall 210. The at least one cam member 240 further includes a lever 244 depending from the cam member 240, where the lever enables pivotal movement of the cam member's grooved edge portion 242 away from the interior wall 210 for releasing a line of rope received within the first passage 216 between the cam member's grooved edge portion 242 and the interior wall 210.

In the second embodiment shown in FIG. 4, the device 200 preferably includes only a single cam member 240. A rope may be easily inserted into the first aperture 212 and through the second aperture 214, but movement of the rope in direction D1 (opposite the insertion direction) will only urge the sharp edge E of the cam member 240 to rotate towards the interior wall 210 and to grip the rope more tightly. While the second embodiment has a single cam member 240 biased to rotate in a single direction, other embodiments may have additional cam members.

Figure 5:
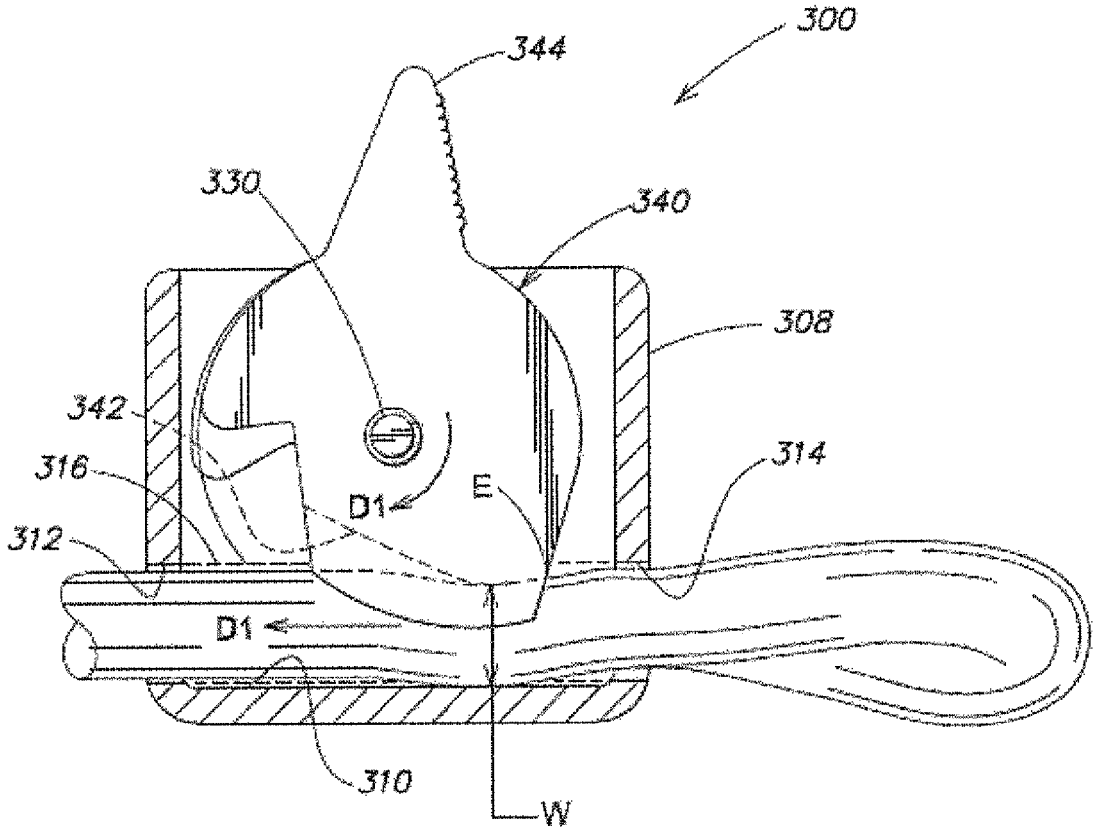
FIG. 5 is a cross-sectional view of a third embodiment of a device for securing an end portion of a length of rope, according to another aspect of the present disclosure.
Figure 6:
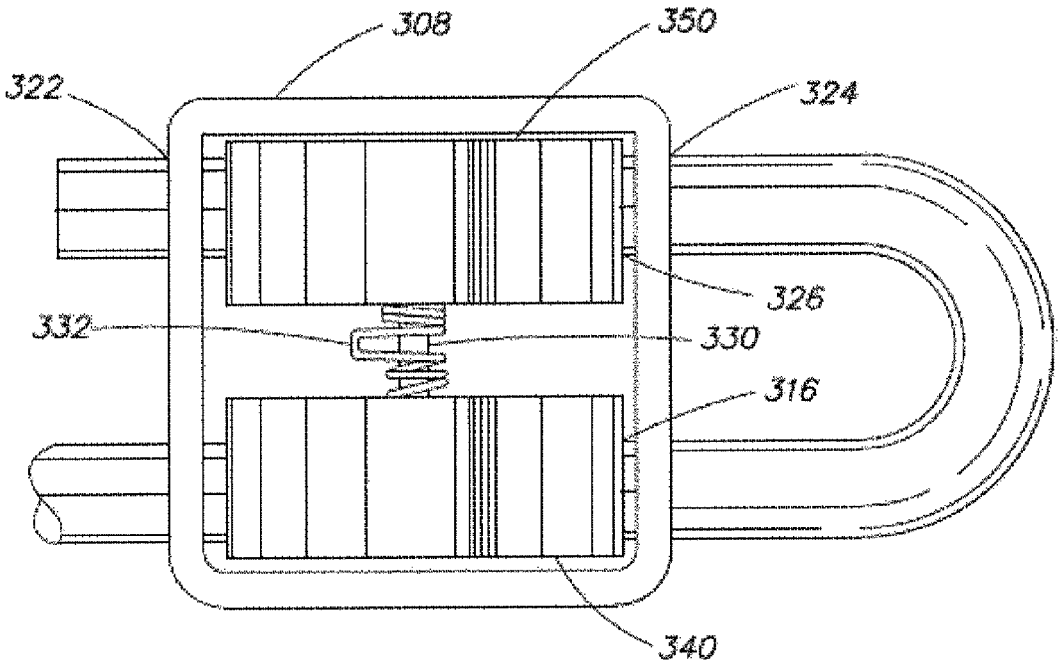
FIG. 6 is a top elevation view of a third embodiment of a device for securing an end portion of a length of rope, according to another aspect of the present disclosure.

Referring to FIGS. 5-6, a third embodiment of a device for securing a portion of a length of rope is shown generally at 300. The device 300 includes a housing 308 with at least one pair of apertures 312, 314 therein defining a first passage 316 through the housing 308 for receiving a line of rope, where the housing 308 has an interior wall 310 underlying the at least one aperture 312, 314 defining the first passage 316. More preferably, the at least one pair of apertures in the housing 308 includes a first pair of apertures 312, 314 defining a first passage 316 through the housing 308 for receiving a first portion of a rope, and a second pair of apertures 322, 324 defining a second passage 326 through the housing 308 for receiving a second portion of a rope.

The third embodiment of a device 300 for securing a length of rope further includes a pin 330 extending at least partially through the interior of the housing 308, and a torsion spring 332 disposed within the housing 308. The device 300 further includes at least one cam member 340 with a grooved edge portion 342, being pivotally mounted on the pin 330 and biased by the torsion spring 332 so as to pivot the cam member 340 and grooved edge portion 342 in a direction towards the interior wall 310 for engaging a line of rope received within the first passage 316 between the cam member's grooved edge portion 342 and the interior wall 310. The at least one cam member 340 further includes a lever 344 depending from the cam member 340, where the lever enables pivotal movement of the cam member's grooved edge portion 342 away from the interior wall 310 for releasing a line of rope that is received within the first passage 316 between the cam member's grooved edge portion 342 and the interior wall 310. More preferably, the at least one cam member of the device 300 comprises a first cam member 340 and a second cam member 350, where the first cam member 340 and the second cam member 350 are each mounted in parallel in the same direction as the other. Like the first cam member 340, the second cam member 350 has a grooved edge portion, and is pivotally mounted on the pin 330 and biased by the torsion spring 332 so as to pivot the cam member's grooved edge portion 342 in a direction towards the interior wall 310 for engaging a portion of the rope received within the second passage 326. In the third embodiment of a device 300 for securing a length of rope, the torsion spring 332 preferably biases the first and second cam members 340, 350 to urge both the first and second cam members 340, 350 to rotate in the same direction, but in other embodiments, the cam members can be biased in opposite directions.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A device for securing an end portion of a length of rope for mooring a vessel, the device comprising:

a housing with a first pair of apertures defining a first passage through the housing for receiving a length of a rope therethrough and a second pair of apertures defining a second passage through the housing for receiving an end portion of said rope therethrough, the housing having an interior wall underlying the first and second pair of apertures defining the first and second passages;

a pin extending at least partially through the interior of the housing;

a torsion spring disposed within the housing;

a first cam member having a grooved edge portion and a lever, the grooved edge portion being a concave contact face extending the opposite end of the lever, the grooved edge portion further being pivotally mounted on the pin and biased by the torsion spring so as to pivot the first cam member's grooved edge towards the interior wall for engaging a length of rope received within the first housing passage between the first cam member's grooved edge and the interior wall, the lever being configured to enable pivotal movement of the cam member's grooved edge away from the interior wall for releasing said length of rope received in the first passage; and a second cam member having a grooved edge portion and a lever, the grooved edge portion being a concave contact face extending the opposite end of the lever, the grooved edge portion further being pivotally mounted on the pin and biased by the torsion spring so as to pivot the cam member's grooved edge in a direction towards the interior wall for engaging an end portion of said rope received within the second housing passage between the second cam member's grooved edge and the interior wall, the lever being configured to enable pivotal movement of the second cam member's grooved edge away from the interior wall for releasing the end portion of said rope received within the second housing passage.

2. The device of claim 1, wherein the torsion spring biases the first and second cam members to urge the first and second cam members to rotate in opposing directions.

3. The device of claim 1, wherein the first cam member is biased by the torsion spring so as to pivot the first cam member's grooved edge in a first direction for engaging and restricting movement of said length of rope in the first direction, and the second cam member is biased by the torsion spring so as to pivot the second cam member's grooved edge in a second direction opposite the first direction for engaging and restricting movement of the end portion of said rope in said second direction.

4. The device of claim 1, wherein the first and second pairs of apertures are arranged in the housing such that an end portion of a rope may be inserted through the first pair of apertures and the second pair of apertures to thereby form a loop for attachment to a mooring post.

5. The device of claim 1, wherein the first and second cam members have a grooved edge that comprises a generally cam member-shaped slot in which a length of rope may be received.

6. The device of claim 5 wherein the grooved edge portion has a sharp edge for engaging and gripping a rope received between the grooved edge portion and the interior wall.

7. The device of claim 1, wherein the first and second cam members are configured to provide a restraining force of at least 500 pounds to a length of rope received within the first and second pairs of apertures.

8. A device for securing a portion of a length of rope, the device comprising:

a housing with at least one pair of apertures therein defining a passage through the housing for receiving a line of rope, the housing having an interior wall underlying the at least one aperture defining the passage;

a pin extending at least partially through the interior of the housing;

a torsion spring disposed within the housing;

at least one cam member having a grooved edge portion and a lever, the grooved edge portion being a concave contact face extending the opposite end of the lever, the grooved edge portion further being pivotally mounted on the pin and biased by the torsion spring so as to pivot the cam member's grooved edge in a direction towards the interior wall for engaging a line of rope received within the housing passage between the cam member's grooved edge and the interior wall; and the lever being configured to enable pivotal movement of the cam member's grooved edge away from the interior wall for releasing a line of rope received within the housing passage between the cam member's grooved edge and the interior wall.

9. The device of claim 8, wherein the at least one pair of apertures comprises a first pair of apertures defining a first passage through the housing for receiving a first portion of a rope, and a second pair of apertures defining a second passage through the housing for receiving a second portion of a rope.

10. The device of claim 9, wherein the at least one cam member comprises a first cam member with a grooved edge portion, being pivotally mounted on the pin and biased by the torsion spring so as to pivot the first cam member's grooved edge towards the interior wall for engaging a length of rope received within the first housing passage, and a second cam member with a grooved edge portion, being pivotally mounted on the pin and biased by the torsion spring so as to pivot the cam member's grooved edge in a direction towards the interior wall for engaging an end portion of said rope received within the second passage.

11. The device of claim 10 wherein the first cam member and the second cam member are each mounted in parallel in the same direction as the other.

12. The device of claim 11, wherein the torsion spring biases the first and second cam members to urge both the first and second cam members to rotate in the same direction.

13. The device of claim 10 wherein the first cam member and the second cam member are each mounted for pivoting in opposing directions with respect to each other.

14. The device of claim 13, wherein the torsion spring biases the first and second cam members to urge the first and second cam members to rotate in opposing directions.

15. The device of claim 10, wherein the first cam member is biased by the torsion spring so as to pivot the first cam member's grooved edge in a first direction for engaging and restricting movement of said length of rope in the first direction, and the second cam member is biased by the torsion spring so as to pivot the second cam member's grooved edge in a second direction opposite the first direction for engaging and restricting movement of the end portion of said rope in said second direction.

16. The device of claim 15, wherein the first and second pairs of apertures are arranged in the housing such that an end portion of a rope may be inserted through the first pair of apertures and the second pair of apertures to thereby form a loop for attachment to a mooring post.

17. The device of claim 16, wherein the first and second cam members have a grooved edge that comprises a generally cam member-shaped slot in which a length of rope may be received.

18. The device of claim 15, wherein the first and second cam members are configured to provide a restraining force of at least 500 pounds to a length of rope received within the first and second pairs of apertures.

19. A device for securing an end portion of a length of rope for mooring a vessel, the device comprising:

a housing with a first pair of apertures defining a first passage through the housing for receiving a length of a rope therethrough and a second pair of apertures defining a second passage through the housing for receiving an end portion of said rope therethrough, the housing having an interior wall underlying the first and second pair of apertures defining the first and second passages;

a pin extending at least partially through the interior of the housing;

a torsion spring disposed within the housing;

a first cam member having a grooved edge portion and a lever, the grooved edge portion being a concave contact face extending the opposite end of the lever, the grooved edge portion further being pivotally mounted on the pin and biased by the torsion spring so as to pivot the first cam member's grooved edge towards the interior wall for engaging a length of rope received within the first housing passage between the first cam member's grooved edge and the interior wall, the lever being configured to enable pivotal movement of the cam member's grooved edge away from the interior wall for releasing said length of rope received in the first passage;

a second cam member having a grooved edge portion and a lever, the grooved edge portion being a concave contact face extending the opposite end of the lever, the grooved edge portion further being pivotally mounted on the pin and biased by the torsion spring so as to pivot the cam member's grooved edge in a direction towards the interior wall for engaging an end portion of said rope received within the second housing passage between the second cam member's grooved edge and the interior wall, the lever being configured to enable pivotal movement of the second cam member's grooved edge portion away from the interior wall for releasing the end portion of said rope received within the second housing passage; and wherein the first cam member is biased by the torsion spring so as to pivot the first cam member's grooved edge in a first direction for engaging and restricting movement of said length of rope in the first direction, and the second cam member is biased by the torsion spring so as to pivot the second cam member's grooved edge in a second direction opposite the first direction for engaging and restricting movement of the end portion of said rope in said second direction.

20. The device of claim 19, wherein the first and second pairs of apertures are arranged in the housing such that an end portion of a rope may be inserted through the first pair of apertures and the second pair of apertures to thereby form a loop for attachment to a mooring post.

* * * * *